United States Patent [19]

Lauener et al.

[11] Patent Number: 4,848,635

[45] Date of Patent: Jul. 18, 1989

[54] PROCESS AND DEVICE FOR DRIVING AND SYNCHRONIZING ROLLS

[75] Inventors: Wilhelm F. Lauener, Gerlafingen, Switzerland; Rolf Würgler, Esslingen, Fed. Rep. of Germany

[73] Assignee: Louener Engineering AG, Thun, Switzerland

[21] Appl. No.: 518,541

[22] Filed: Jul. 29, 1983

[30] Foreign Application Priority Data

Aug. 12, 1982 [CH] Switzerland ..... 4830/82

[51] Int. Cl.[4] ..... B65H 20/02; B21B 35/00

[52] U.S. Cl. ..... 226/181; 72/249; 226/188

[58] Field of Search ..... 226/188, 181, 176, 177, 226/154; 72/249; 100/172, 176; 29/115; 254/287, 290; 310/83

[56] References Cited

U.S. PATENT DOCUMENTS

| | | | |
|---|---|---|---|
| 1,032,679 | 7/1912 | Jameson | 72/249 |
| 1,170,463 | 2/1916 | Smith | 254/290 |
| 1,181,155 | 5/1916 | Morgan | 254/290 |
| 2,348,345 | 5/1944 | Hornbostel | 100/172 X |
| 3,213,709 | 10/1965 | Bjork | 100/172 X |
| 3,981,171 | 9/1976 | Kmelisch | 72/249 |
| 4,103,565 | 8/1978 | Matikainen et al. | 72/249 X |
| 4,152,912 | 5/1979 | Shiozaki et al. | 72/249 X |
| 4,365,496 | 12/1982 | Shiozaki et al. | 72/249 |

FOREIGN PATENT DOCUMENTS

| | | | |
|---|---|---|---|
| 2555446 | 6/1977 | Fed. Rep. of Germany | 72/249 |
| 56-14008 | 2/1981 | Japan | 72/249 |
| 582016 | 1/1978 | U.S.S.R. | 72/249 |
| 651864 | 3/1979 | U.S.S.R. | 72/249 |

*Primary Examiner*—Harvey C. Hornsby
*Assistant Examiner*—Scott J. Haugland
*Attorney, Agent, or Firm*—Sheridan, Ross & McIntosh

[57] ABSTRACT

A process for driving and synchronizing rolls, in particular the rolls of a strip casting facility, is such that each roll is driven by a separate motor drive via gearing, and the turning speed of the motor is regulated. The synchronizing of the motor drives during idling of the rolls takes place via miter gearing coupled to the motors and a sliding coupling between these sets of gears in addition to a shaft connecting them; the synchronizing is undertaken via manual or automatic control of motor turning speed as a function of roll speed and roll diameter.

4 Claims, 1 Drawing Sheet

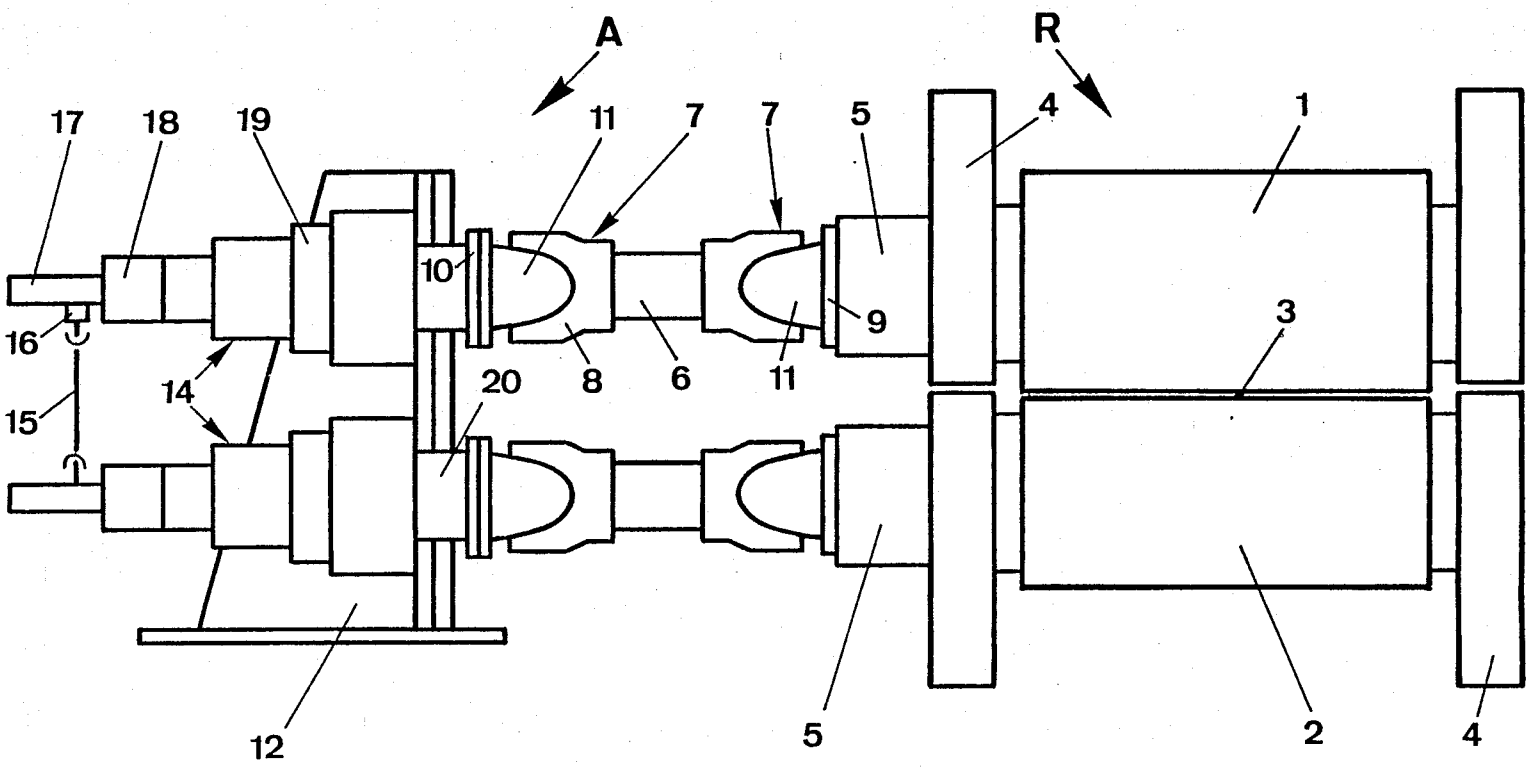
R
A
1
2
3
4
4
5
5
6
7
7
8
9
10
11
11
12
14
15
16
17
18
19
20

PROCESS AND DEVICE FOR DRIVING AND SYNCHRONIZING ROLLS

BACKGROUND OF THE INVENTION

The invention relates to a process for driving and synchronization rolls, in particular rolls of a strip casting facility, and relates too to a device for this purpose.

Devices for example for continuous strip casting or conventional facilities for rolling strip material are normally driven by a single motor drive. The synchronization of the pair of rolls is usually performed by a grooved roller gear between the drive and the casting or rolling device. Step-down gears accommodating the ratio of turning speeds of the drive and the individual rolls are then required.

This combined step-down grooved roller gearing or, if no speed reduction is necessary, the appropriate grooved roller gearing is always a special construction, which is expensive to purchase and very problematic to maitain. The break-down of grooved roller gearing usually results in a long period of down time in production.

Furthermore, the diameters of the rolls which should run in synchrony have to be matched within relatively close tolerance limits. However, with known devices for rolling and in particular with roll-type strip casters the wear on the rolls is very heavy. After a certain time therefore these rolls have to be removed and reground. As the wear on the rolls is usually non-uniform, the diameter of the rolls has to be reduced by a greater amount than would in fact be necessary. As a rule the cost of purchasing new rolls represents a significant factor in the running costs.

SUMMARY OF THE INVENTION

It is therefore an object of the present invention to develop a process of the above mentioned kind wherein these disadvantages do not appear but proper synchronization between the individual rolls is still assured. The process and the device should in particular show as little as possible susceptibility to breaking down.

This object is achieved by way of the process and device of the invention wherein each individual roll is driven by a motor via gearing and the turning speed of the motor is regulated. This individual motor drive makes the whole unit less susceptible to breaking down. If, for example, the motor drive in a conventional unit should break down, then the whole unit comes to a standstill. With the individual motor drive according to the invention, if a motor fails during operation then there is the possibility, in particular in the case of strip casting, that the roll which is no longer powered will at least continue to turn until the end of the cast.

BRIEF DESCRIPTION OF THE DRAWING

Further advantages, features and details of the invention are explained in the following description of a preferred exemplified embodiment of the invention and with the help of the accompanying drawing which shows a schematic representation of a drive A for strip casting device R.

DETAILED DESCRIPTION

According to the invention two possibilities for synchronizing the motor drives are envisaged.

The turning speed of each motor drive can be regulated manually or automatically. Parameters to achieve synchronous rotation of the rolls are in particular the required roll speed and the related roll diameter. Regulation can be made for example by means of a process computer.

One possibility for achieving the drive is to couple the motor drives for the rolls via miter gears with built in sliding coupling and, if desired, additional shafts. The sliding coupling can be set at a low turning moment which is still sufficient to keep the rolls turning at the desired speed while idling. This ensures that during idling the turning speeds of both drive units are kept in synchrony, at the start of casting however the faster turning roll can adjust to the speed of the slower turning roll thanks to the sliding coupling, so that completely identical speeds at the periphery of the rolls are achieved during casting. The diameter of the rolls is then of no importance so that it is also possible to employ rolls of different diameter, which is of course very cost saving. In the normal case 2–3 mm are machined away from the roll periphery. The roll can on average be treated this way 4 to 6 times. The process according to the present invention permits the use of rolls which differ to all extents in terms of their diameters, i.e. it is completely possible to run the machine with a new roll of maximum diameter and another roll which has a minimum diameter after repeated machining. This possibility of machining each roll according to its individual condition results in a considerable increase in the service life of the roll surface.

A device for carrying out the process i.e. for driving and synchronizing rolls, in particular rolls of a strip caster, is such that each roll is connected to a variable motor drive with gearing. The motor drive can be powered electrically or hydraulically. Hydraulic motor drives have shown themselves to be more prone to breaking down. For the gearing one can consider a commercially available reduction gear, usefully planetary gearing, which is again cost saving and makes the whole unit less prone to breaking down. Miter gears, sliding coupling and shaft between the gears are likewise available commercially and therefore inexpensive.

Referring to the drawing the strip casting device R comprises an upper roll 1 and a lower roll 2 which form a roll gap 3 between them. Both rolls 1 and 2 turn on bearings in frame parts 4 by means of which, but not shown here, they can be raised or lowered, thus determining the width of the roll gap 3.

Both rolls 1 and 2, on the side towards the drive A and on the far side of the related frame parts 4, feature coupling elements 5, each of which is engaged by a drive spindle 6. These spindles 6 permit the levels of rolls 1 and 2 to be altered without having to adjust the drive A accordingly. To this end, on the side towards the drive A and the strip casting unit R, each features a universal joint 7, one part 11 of which is securely attached to the spindle 6, while the other part 11 of each connects via end plate 9 to the coupling element 5 or to an end plate 10 of the drive A.

The drive A comprises two drive units 14, arranged one above the other on a stand 12, which are connected via a Cardan shaft 15 and a sliding coupling 16 to a miter gear 17.

The miter gear 17 is coupled to a motor 18 which drives a planetary gear 19 the shaft 20 of which passes through the stand 12 and carries at its end the end plate 10.

What is claimed is:

1. Device for driving and synchronizing rolls, in particular rolls of a strip casting facility, which comprises rolls in spaced relationship to each other with a roll gap therebetween, a separate, individual adjustable motor drive connected to each roll and gearing means operatively connected to each motor drive for synchronizing the turning speed of the motor drives and maintaining the turning speeds of both drive units in synchrony during idling, by means of miter gearing and a shaft connected to the miter gearing by means of a sliding coupling, whereby said rolls are separately driven in synchronization.

2. Device according to claim 1 wherein each motor drive includes individual gearing.

3. Device according to claim 2 wherein the gearing is reduction gearing.

4. Device according to claim 2 wherein the gearing is planetary gearing.

* * * * *

UNITED STATES PATENT AND TRADEMARK OFFICE

CERTIFICATE OF CORRECTION

PATENT NO. : 4,848,635

DATED : July 18, 1989

INVENTOR(S) : Lauener et al

It is certified that error appears in the above-identified patent and that said Letters Patent is hereby corrected as shown below:

On the title page, assignee, "Louener" should read --Lauener--.

Column 2, line 8 of Abstract, "synchronizing" should read --synchronization--.

Column 1, line 7, "synchronization" should read --synchronizing--.

Column 1, line 22, "maitain" should read --maintain--.

Column 1, line 67,"." should read --:--.

Signed and Sealed this

Ninth Day of October, 1990

*Attest:*

HARRY F. MANBECK, JR.

*Attesting Officer*

*Commissioner of Patents and Trademarks*